US006037899A

United States Patent [19]

Weber

[11] Patent Number: 6,037,899

[45] Date of Patent: Mar. 14, 2000

[54] METHOD FOR VECTORING ACTIVE OR COMBAT PROJECTILES OVER A DEFINED OPERATIVE RANGE USING A GPS-SUPPORTED PILOT PROJECTILE

[75] Inventor: Adolf Weber, Neunkirchen, Germany

[73] Assignee: Rheinmetall W&M GmbH, Unterluess, Germany

[21] Appl. No.: 09/072,025

[22] Filed: May 5, 1998

[30] Foreign Application Priority Data

May 5, 1997 [DE] Germany ..... 197 18 947.4

[51] Int. Cl.[7] ..... G01S 5/02; H04B 7/185

[52] U.S. Cl. ..... 342/357.06; 342/357.01; 701/213; 244/3.2

[58] Field of Search ..... 342/357.01, 357.06, 342/62; 701/213; 244/3.1, 3.2, 3.15

[56] References Cited

U.S. PATENT DOCUMENTS

| | | | |
|---|---|---|---|
| 5,647,558 | 7/1997 | Linick | 244/3.11 |
| 5,881,969 | 3/1999 | Miller | 244/3.17 |

FOREIGN PATENT DOCUMENTS

| | | |
|---|---|---|
| 0 261 091 | 3/1988 | European Pat. Off. . |
| 1487656 | 3/1975 | United Kingdom . |
| 2107835 | 5/1983 | United Kingdom . |
| 90/08936 A1 | 8/1990 | WIPO . |
| 97/48963 A1 | 12/1997 | WIPO . |

*Primary Examiner*—Thomas H. Tarcza
*Assistant Examiner*—Dao L. Phan
*Attorney, Agent, or Firm*—Venable; Norman N. Kunitz

[57] ABSTRACT

For an exact vectoring of active or combat projectiles, a GPS-supported pilot projectile is provided with a satellite navigation system or GPS receiver and continuously detects its own position and speed during the complete operational (firing) sequence—and thus also the ballistic interference variables—and transmits this information via a transmitter to the ordnance unit for evaluation and correction of the firing parameter of a subsequently fired active or combat projectile. If the active or combat ammunition or projectile to be vectored is equipped with submunitions, then the GPS receiver and the transmitter are located in the pilot submunition, so that the ballistic interference variables affecting the submunition can be recorded as well.

5 Claims, 2 Drawing Sheets

METHOD FOR VECTORING ACTIVE OR COMBAT PROJECTILES OVER A DEFINED OPERATIVE RANGE USING A GPS-SUPPORTED PILOT PROJECTILE

CROSS-REFERENCE TO RELATED APPLICATION

This application claims the priority of Patent Application Serial No. DE 197 18947.4, filed in Germany on May 5, 1997, the subject matter of which is incorporated herein by reference.

BACKGROUND OF THE INVENTION

The invention relates to a pilot projectile, supported by a satellite navigation system, e.g. a GPS=global positioning system, which projectile is fired first during an attack operation on a target and can determine the prevailing influencing variables for the external ballistics of subsequently fired, frequently very expensive active or combat projectiles. As a result of the constant position determination and speed measuring, it is possible to undertake the corrections that may be required for the active or combat projectiles to permit a more accurate striking of the targets to be attacked.

It is well known that artillery forces, for example, use forward observers or drones to detect enemy targets, map their location and report the position of said targets to the ordnance unit assigned to attack these targets. The ordnance unit subsequently determines the required charges and aiming values for each weapon, and the first firings occur. Following this, the forward observer or the reconnaissance drone then attempts to locate the strike locations. The detected tolerances are subsequently reported back to the ordnance unit, where corresponding correction values are determined and the attack is continued.

The above described method is cheap and relatively easy to carry out with low-cost, explosive ammunition, since relatively high amounts of explosive are detonated and the strikes on the ground or several meters above the ground (if velocity-time fuses are used) are well marked and can be observed easily. When using very expensive, intelligent ammunition, e.g., the 155 mm SMART or the SADARM, or when using mortar ammunition with higher combat effectivity, reconnaissance is considerably more difficult owing to the much lower explosive masses, and the method of using expensive active ammunition for the range finding is particularly cost-intensive.

It is therefore an object of the present invention to provide a method wherein by use of a pilot projectile, the active strike position of a active or combat projectile can be predicted with sufficient accuracy by additionally taking into account the ballistic tolerances due to weather and environmental conditions for the active projectile and which is considerably less expensive than the presently used methods as described above.

SUMMARY OF THE INVENTION

The above object generally is achieved according to the present invention by using a new pilot projectile, for which the external profile, material mass, mass inertial values and, if necessary, operational sequence correspond to those of the active or combat projectile to be vectored or directed to a given target. This pilot projectile or the submunition for this projectile are provided with a GPS receiver and a transmitter for continuously transmitting the current position (longitude, latitude, elevation) and speed of the pilot projectile to a receiver during the complete operational or firing sequence of the pilot projectile, so that a further evaluation (variance comparison) and corrections for a subsequently fired combat or active projectile can be made. This receiver can be directly located at the ordnance unit which controls, firing of the projectiles or be located at an advance observer or reconnaissance drone, which then transmits the information to the ordnance unit.

The desired strike location thus can be sighted with a lot more accuracy, and the aim of the weapons accordingly can be adjusted more accurately and less expensively.

DETAILED DESCRIPTION OF THE PREFERRED EMBODIMENTS

Figure 1:
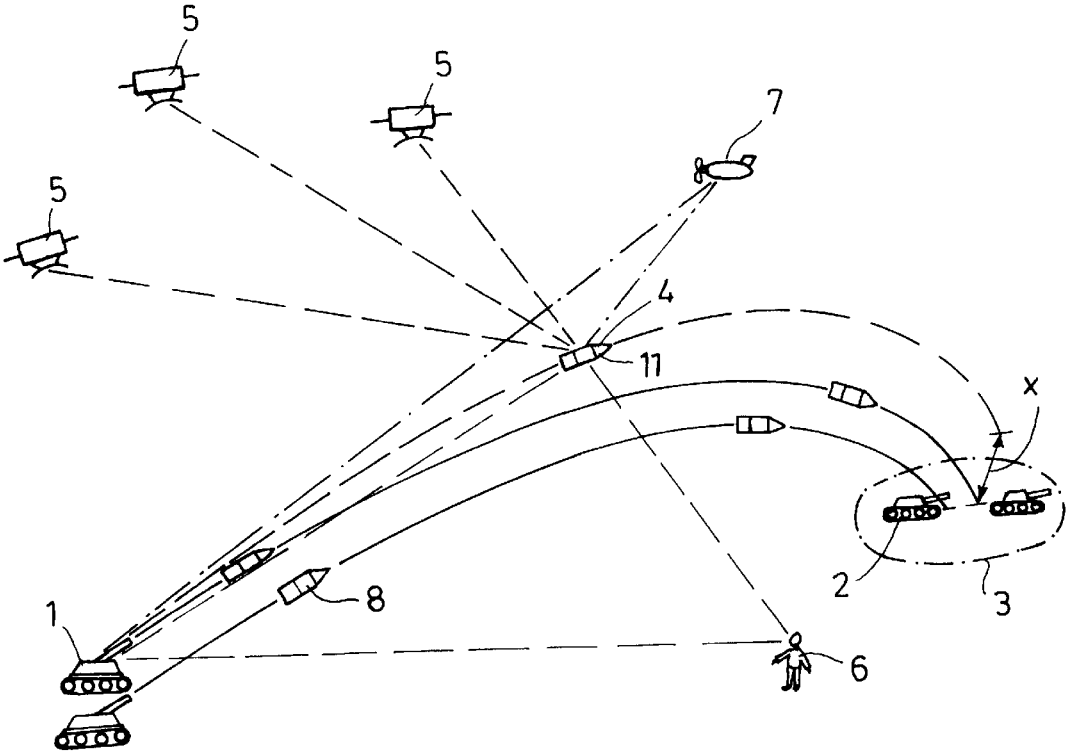
FIG. 1 is a schematic diagram illustrating the method according to the intention for a pilot projectile according to the invention.

FIG. 1 shows an ordnance unit in the firm of weapon carriers 1, e.g., Howitzers or mortar-equipped armored vehicles, in position and the targets 2 to be combated. FIG. 1 also shows the desired effective zone or target area 3 at which active or combat projectiles as well as a pilot projectile 4 are to be fired. As shown, the fired pilot projectile 4, which has an on-board satellite navigation receiver, e.g., a GPS receiver, because of aerodynamic scattering, principally under the effect of wind, does not reach or land in the effective zone 3 but touches down at a distance X from the desired effective zone 3. During the entire operational or flight phase, the on-board receiver of the pilot projectile 4 receives from the GPS satellites 5, its own geodesic position and, via and on-board transmitter, reports or transmits the received position information to an intended receiver, e.g., at weapon unit 1, an advanced observer 6 or a reconnaissance drone 7. The observer 6 and drone 7 would then transmit the information to the weapon unit 1. Based on the thus-determined touchdown distance X from the desired effective zone 3, a computer at the weapon unit 1, in a known manner, executes the required directional corrections and thereupon an effective combating of the target 2 with a subsequently fired combat ammunition or projectile 8 is feasible. To achieve this desired result, the pilot projectile 4 has an external form, mass and mass inertial values which substantially coincide with the corresponding values of a subsequently fired combat projectile 8.

Figure 2:
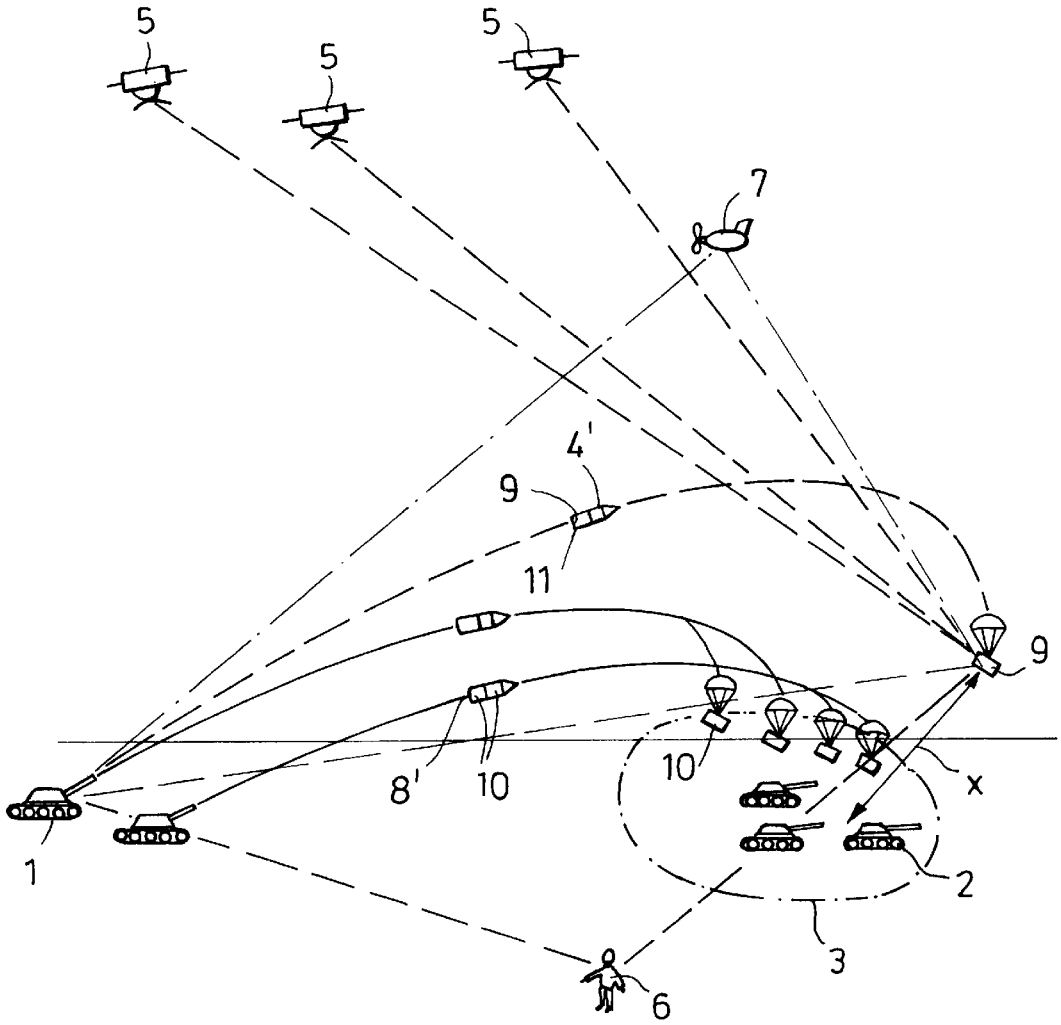
FIG. 2 is a schematic diagram illustrating the method according to the intention for a pilot projectile according to the invention which is provided with at least one submunition.

FIG. 2 shows, similarly to FIG. 1, the same process when a pilot projectile containing subammunition is used. In the pilot projectile 4' there is positioned the GPS-subammunition 9 which, in its external behavior, is identical to the combat subammunition 10, and which in this embodiment has the on-board GPS-receiver and the transmitter. The GPS subammunition 9 is, according to a set flight time, ejected from the pilot projectile 4' and floats to the ground by parachute (for example, SMART or SADARM) and receives, during the entire flight phase, its own geodesic position from the GPS satellites 5 and reports or transmits this information to an intended receiver located at weapon unit 1, the advanced observer 6 or the reconnaissance drone 7. In a manner similar to the FIG. 1, the observer 6 and the drone 7 then transmit this information to the weapon system 1.

Based on the thus-determined touchdown distance X from the desired effective zone 3, the weapon unit 1 executes the required directional corrections and thereupon an effective combating of the target 2 with the combat ammunition 8' and the combat subammunition 10 contained therein is feasible. In the case with the embodiment of FIG. 2, wherein the active projectile 8' to be vectored or directed is equipped with submunition 10, then as indicated above, the pilot projectile 4' is also equipped with at least one submunition 9, having identical weight, mass inertial values and rate of speed of vertical descent as the active submunition 10. In this case, the receiver and transmitter are installed in the submunition 9. Submunitions are particularly wind-sensitive, owing to the fact that they drop at a slower rate of vertical descent as compared to the parent projectile. Example: The submunition is ejected at an elevation of 300 m and is activated at an elevation of 100 m. With a rate of speed of vertical descent of 12 m/s and a wind speed in the target region of 10 m/s, the submunition is put off course approximately 160 m before it is activated and possibly misses the target. The wind velocity in the target area is not known to the combat or ordnance unit. With the suggested measure, this interference variable is included as well and is incorporated into the calculation. The weapons can be correspondingly readjusted by the fire control post and the active projectiles can be deployed.

The invention now being fully described, it will be apparent to one of the ordinary skill in the art that many changes and modifications can be made thereto without departing from the spirit or scope of the invention as set forth herein.

What is claimed:

1. A method for vectoring active projectiles over an operative target area range comprising:

providing a pilot projectile or submunition for the pilot projectile with a satellite navigation receiver, and a transmitter, and with the external form, mass and mass inertial moments of the pilot projectile or submunition, including the rate of speed of vertical descent for the submunition, substantially coinciding with the corresponding values for the active projectile or active submunition to be fired at a target area;

firing the pilot projectile toward a target area;

continuously detecting the current position, as well as the pilot projectile/submunition speed during the complete operational sequence of the pilot projectile using the satellite navigation receiver; and, transmitting the received position information to a desired target receiver for evaluation and formation of correction values for a subsequently fired active projectile.

2. The method according to claim 1, wherein the active projectile for vectoring contains a submunition; and wherein the method further comprises: ejecting the pilot projectile submunition from the pilot projectile with the aid of a delayed-action fuse in the same manner as during the operational sequence for the active projectile; and causing the further operational sequence for the submunition of the pilot projection to substantially coincide with that of the active ammunition with respect to external ballistics and intermediate ballistics.

3. The method according to claim 1, wherein the desired targeted receiver for the position information is located at one of the ordnance unit assigned to attack the target, or at an advanced observer or a reconnaissance drone, which then transmits the position information to the ordnance unit.

4. A global positioning system (GPS) supported pilot projectile for use in vectoring a subsequently fired active or combat projectile according to claim 1, with the pilot projectile comprising: a pilot projectile having an external form, mass and mass inertial moments substantially coinciding with corresponding values of an active projectile; a satellite navigation receiver disposed in the pilot projectile; and a radio transmitter disposed in the pilot projectile for transmitting position data received by the satellite navigation receiver to a desired receiver.

5. A pilot projectile as defined in claim 4 wherein: the active projectile has an active submunition; the pilot projectile has a submunition having an external form, mass, mass inertial moments and rate of speed of vertical descent coinciding with corresponding values of the active submunition of the active projectile; and the satellite navigation receiver and the transmitter are disposed in the submunition of the pilot projectile.

* * * * *